United States Patent [19]

Malan

[11] 4,114,199

[45] Sep. 19, 1978

[54] DISPOSABLE BIB TRAY

[76] Inventor: Mabel Malan, 420 College Park Dr., Lynchburg, Va. 24502

[21] Appl. No.: 782,700

[22] Filed: Mar. 30, 1977

[51] Int. Cl.[2] ..... A41B 13/10

[52] U.S. Cl. ..... 2/49 A

[58] Field of Search ..... 2/49 A, 49; 229/30, 229/31 R, 34 B

[56] References Cited

U.S. PATENT DOCUMENTS

| | | | |
|---|---|---|---|
| 1,108,557 | 8/1914 | Dudley | 2/49 R |
| 2,164,369 | 7/1933 | Woolever | 2/49 R |
| 2,265,690 | 12/1941 | Fiedler | 2/49 A |
| 2,531,255 | 11/1950 | Clarke | 229/30 |
| 2,672,614 | 3/1954 | Zimmerman et al. | 2/49 A |

*Primary Examiner*—Doris L. Troutman

[57] ABSTRACT

A bib-tray structure for use during the feeding of an infant is fabricated from suitably stiff and tear resistant thin sheet material such as paper cut and folded so as to comprise a bib portion, a tray portion, and an interconnecting transition region having accordian folds adapted to provide adjustability of height of the structure. The bib portion contains neck straps which are adjustably interengagable. The tray portion contains borders which permit facile assembly of a serving surface bounded by retaining walls.

7 Claims, 3 Drawing Figures

DISPOSABLE BIB TRAY

BACKGROUND OF THE INVENTION

This invention relates to a combined protective bib and tray product for use during the feeding of infants or invalids, and more particularly to a disposable bib-tray product inexpensively fabricated from suitably stiff and tear resistant thin sheet material such as paper.

In the course of the feeding of infants, portions of food may become deposited on the infant or his clothes, or on the surface on which the food and eating utensils are placed for serving purposes. Protective sheet-like garments, generally known as bibs, which depend from the infant's neck have been utilized to minimize the deposition of food on the infant and to simplify clean-up after the meal. Such protective garments are also useful with invalids or handicapped persons. The soiled bib may be re-used after cleaning, or discarded if economically feasible.

In the confines of the home, the tray or table on which the food is placed for serving is of known cleanliness, and proper cleaning materials and equipment are available for proper maintenance of clean sanitary conditions. When traveling with infants, it is often found necessary to feed the infant in a commercial restaurant where the tables or tray-equipped infant's high chair may be in an unknown or obviously unsatisfactory state of cleanliness. Under such circumstances it is also inconvenient or impossible to conduct a thorough cleaning of the tray or table surface prior to use, or clean the infant, the bib, and the tray or table after the feeding session.

The use of inexpensive baby's bibs which are intended to be discarded following a single use have been disclosed in U.S. Pat. No. Re. 24043, U.S. Pat. No. Des. 232,276, and elsewhere. Although such products minimize the effort required in keeping the infant clean, they do not protect the infant from the potential consequences of an unsanitary tray surface. Such products have also generally been unable to adjust to different neck sizes.

Bibs provided with an integrally attached lap or tray portion have been disclosed in U.S. Pat. No. 1,108,557, wherein the purpose of the tray portion is primarily to prevent food from falling between the infant and the table or other food supporting surface. The bib-tray structure of said U.S. Pat. No. 1,108,557 is not intended as an expendable item to be discarded after a single use. It also lacks adjustability in its dimensions, thereby necessitating various sizes of the bib-tray to accommodate wearers of different heights. Another shortcoming of the bib-tray of U.S. Pat. No. 1,108,557 is that it lacks adjustability with respect to the distance separating the wearer from the serving surface.

Accordingly, it is an object of the present invention to provide an inexpensive, expendable item to be worn by infants or invalids during their feeding. It is another object to provide an expendable item to be worn by infants during their feeding for protection of the infant from being soiled by the food and for provision of a sanitary serving surface. It is a still further object of this invention to provide an expendable item of the aforesaid nature having features of adjustability to accomodate wearers having various heights and neck sizes and to span various distances between the wearer and a table. Other objects and advantages will become apparent hereinafter.

SUMMARY OF THE INVENTION

The objects of this invention are accomplished in general by providing a combined bib-tray product fabricated from reasonably stiff and tear-resistant thin sheet material such as paper. The bib-tray is comprised of a bib portion having neck-fastening means at its uppermost end which enclose an opening of adjustable size, and a apron portion, a series of horizontally disposed accordian folds positioned at the bottom of said bib portion, and a tray portion which originates as a continuous integral extension of the last of said accordian folds. The neck-fastening means is preferably reinforced to prevent tearing and is provided with adjustability of size of opening by means of two strap portions which interlock by adhesive fastening means. The tray portion contains borders adapted to fold upward and interengage to form a tray having confining walls. The bib-tray is preferably fabricated from a single integral piece of paper by cutting and folding techniques, and can be stored in a compactly folded condition prior to deployment for actual use. In a particularly preferred embodiment, the thin sheet material consists of paper containing laminated thereto a thin plastic film which imparts tear and soil resistance.

BRIEF DESCRIPTION OF THE DRAWINGS

In the accompanying drawings forming a part of this specification and in which similar numerals of reference indicate corresponding parts in all the figures of the drawings.

DETAILED DESCRIPTION OF THE INVENTION

Figure 1:
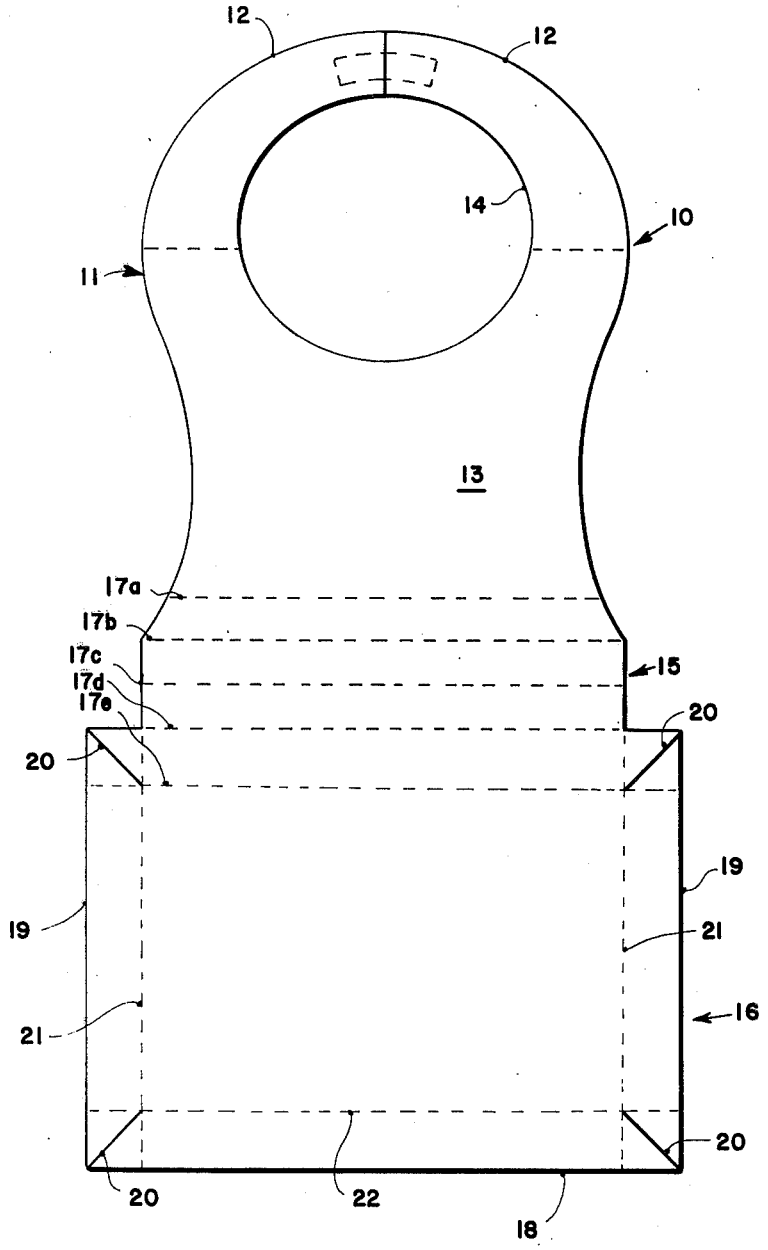
FIG. 1 is a plan view of an embodiment of the bib-tray of this invention in its unfolded state.
Figure 2:
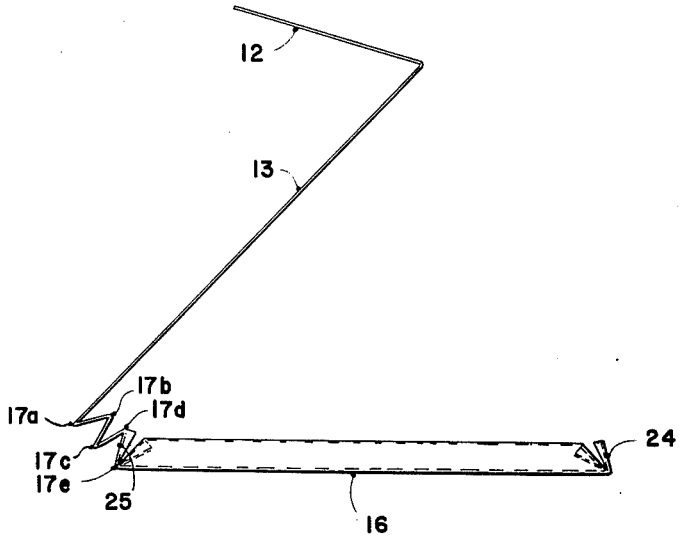
FIG. 2 is a side view of the bib-tray of FIG. 1 in its folded, storage condition.

Referring to FIG. 1, a bib-tray of the present invention is produced from a single flat piece of stiff sheet material 10 by appropriate cutting and folding, and application of fastening means. Bib portion 11 is comprised of opposed neck straps 12, apron portion 13, and opening 14 of adjustable size defined by said neck straps and apron portion. A transition region 15 communicates between said bib portion 11 and rectangular tray portion 16. The transition region is a continuous integral extension of both said bib and tray portions, and contains a series of fold lines 17 disposed in parallel relationship. Fold line **17*a* is adapted to cause the sheet material to fold outwardly, away from bib portion 11. Fold line 17*b* is adapted to cause the sheet material to fold inwardly, toward bib portion 11. Fold lines 17*c*, 17*d* and 17*e* continue in alternating manner to provide outward, inward and outward folding respectively so that, when folded, the folds will stack in accordian-type fashion as shown in FIG. 2. In order to have a more compact folded configuration for ease of storage and shipment, the bib portion is provided with a fold line in the region of the neck straps so that the remaining section of the bib portion will extend approximately to the outer extent of the tray portion in the folded condition, as shown in FIG. 2**.

Tray portion 16 commences as a continuation of transition region 15, extends to outer edge 18, and is bounded by side edges 19. Cuts 20 are provided at each of the four corners of tray portion 16. Side fold lines 21 and outer fold line 22 are positioned equidistantly from their respective edges, and are adapted to enable the respective edges to fold upwardly.

Figure 3:
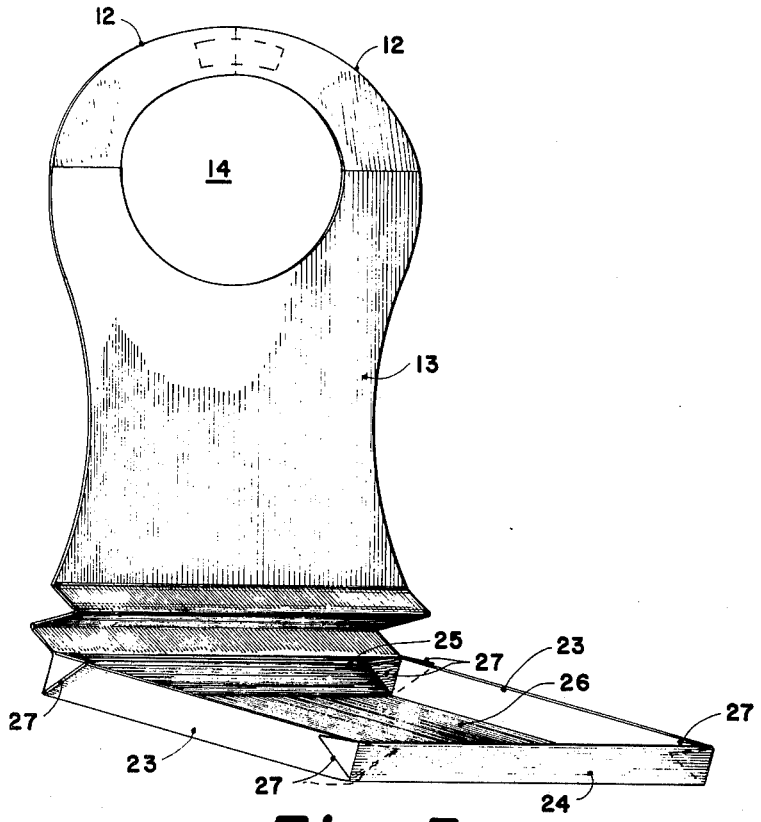
FIG. 3 is a perspective view of the bib-tray of FIG. 1 deployed and assembled for use.

As shown in FIG. 3, the upwardly folded edges form side retaining walls 23 and outer retaining wall 24. The inside retaining wall 25 adjacent apron 13 consists of the last accordian fold in its erected configuration. Said retaining walls are of equal height and define the tray serving surface 26. At each of the corners of tray portion 16, a pair of tabs 27 are formed along each cut 20 in the upwardly folded retaining walls. At each corner, one of said tabs is disposed toward the interior of said serving surface 26 and the other of the pair is disposed outwardly of said serving surface, both being in abutment with the adjacent retaining wall. The tabs are adapted to adhere to the respectively contacted retaining walls by adhesive means which may consist of a water-activatable adhesive, or a contact-type adhesive which achieves bonding merely upon contact.

Although the embodiment shown in the drawings has three equally spaced accordian type folds in the transition region 15, it is to be understood that a larger number of folds may be utilized, and their size and spacing may be varied. However, the height of the lowermost fold should preferably be essentially the same as the height of the front and side retaining walls. The purpose of the folds in the transition region is to permit the tray to be deployed at a level commensurate with the height of the infant wearing the bib-tray and the supporting table that the tray portion will rest on. By maintaining continuity of the sheet material surface extending from the bib portion to the tray portion, food is prevented from falling between said portions.

The diameter of the opening 14 may be adjusted by the extent to which neck straps 12 are overlapped when they are brought into interengagement. Adhesive means for the neck straps may involve either water-activatable glues, or contact type adhesives comprising tacky polymeric species such as for example polyterpenes and polybutenes. The contact type adhesives may be utilized as a coating adapted to adhere either directly to another surface of paper or to interadhere with another coating of a co-acting contact adhesive. In certain embodiments, contact-type adhesive coatings may be protected during storage by special release papers which are removed at the time of assembly and use of the bib-tray.

Although the cuts 20 in the corners of the tray portion have been exemplified as being diagonally placed, other modes of cut design may be utilized. For example, the cuts may be made along fold lines 21 and 22, in which case, the resultant tab portions would have a rectangular shape instead of the triangular shaped portions 27. Although the use of two tabs is preferred in each corner of the tray portion, single tab portions may also be employed. When two tabs are utilized at each corner of the tray portion, one is disposed toward the outside of the tray portion, and the other is disposed toward the inside serving surface 26. In some embodiments, the tray portion may also be provided with means for adhering to the underlying table surface.

The degree of stiffness required in the thin sheet material from which the bib-tray is fabricated is such that a 2 inch rectangular length of said material disposed horizontally and unsupported on one end will show essentially no bending due to its own weight. In preferred embodiments, a 4 inch length will, in the same manner, demonstrate no bending. Preferred materials include paper and reinforced or laminated papers. Certain plastic materials may also be utilized, although ordinary thin, supple films such as those made from polyethylene and polyvinylchloride are unsuitable.

The tear strength of the bib-tray, particularly in areas adjacent the opening in the bib portion should exceed the strength of ordinary letter grade or napkin grade papers. When measured by the standard Elmendorf method, which essentially measures the force required to propagate a tear, the test value should exceed 30 grams. In preferred embodiments, tear test values are in the range of 70 to 320 grams. When the original paper from which a given bib-tray has been fabricated lacks the necessary tear strength, reinforcing means may be employed in areas adjacent the opening in the bib portion. Said reinforcing means include impregnating binders, coatings, and additional layers of sheet material laminated to appropriate portions of the paper.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

What is claimed:

1. A bib-tray for use during the feeding of an infant, fabricated of suitably stiff and tear resistant thin sheet material cut and folded so as to comprise a bib portion having neck-fastening means at its uppermost end which enclose an opening of adjustable size, and an apron portion, a series of parallel accordian folds positioned at the bottom of said bib portion as a continuous extension thereof, said accordian folds being formed by folding said sheet material along at least five parallel lines, and a tray portion originating as a continuous integral extension of the lowermost accordian fold and containing two side borders and an outer border adapted to fold upwardly to form retaining walls which define a serving surface, said retaining walls being held upright by tab appendages of said borders adapted to fold onto and adhesively bond to the next contiguous retaining wall, whereby said tray portion may be disposed at an essentially right angle with respect to said bib portion and adjustably positionable in both vertical and horizontal directions.

2. A bib-tray as defined in claim 1 wherein said neck-fastening means is comprised of two strap portions integral with said apron portion and adapted to join by adhesive means in an overlapping relationship.

3. A bib-tray in accordance with claim 2 fabricated of a single integral piece of paper and containing a fold line in the region of said strap portions in substantially parallel alignment with said accordian folds.

4. A bib-tray in accordance with claim 3 in a compactly folded configuration wherein said bib portion does not extend beyond the outer boundaries of said tray portion.

5. A bib-tray in accordance with claim 1 wherein the height of said lowermost accordian fold is essentially equal to the height of said retaining walls.

6. A bib-tray in accordance with claim 1 wherein said serving surface is essentially retangular and said opening is substantially circular.

7. A bib-tray in accordance with claim 6 wherein two of said tab appendages are utilized at each corner of said tray portion, one of said tabs being adapted to attach to a retaining wall in a manner to face said serving surface, the second tab being adapted to attach to an adjacent retaining wall in a manner to face away from said serving surface, and adhesive means provided to facilitate attachment of the tabs to the respective retaining walls.

* * * * *